United States Patent [19]

Jones

[11] 4,003,578

[45] Jan. 18, 1977

[54] BASS-ANGLERS FISHING CLASSIC GAME

[76] Inventor: Mark A. Jones, 823 N. Winston, Tulsa, Okla. 74115

[22] Filed: May 2, 1975

[21] Appl. No.: 573,964

[52] U.S. Cl. ..... 273/134 AC; 273/134 CB; 273/134 DB; 273/137 R

[51] Int. Cl.[2] ..... A63F 3/00

[58] Field of Search ..... 273/134

[56] References Cited

UNITED STATES PATENTS

| | | | |
|---|---|---|---|
| 3,740,038 | 6/1973 | Feulner | 273/134 AD |
| 3,888,489 | 6/1975 | Kane | 273/134 B |

*Primary Examiner*—Delbert B. Lowe
*Attorney, Agent, or Firm*—Head, Johnson & Chafin

[57] ABSTRACT

A game in which a printed board or sheet piece provided with a representation of a lake and surrounding earth or land area imprinted thereon and having a grid arrangement superimposed on at least the lake or water areas to provide playing spaces for movement of playing pieces along the grid, each move being determined by the casting of at least one die, with the end result of the game play corresponding generally to the well known bass anglers' fishing tournament which is commonly called Bass Masters Classic. Tokens representative of fish are loosely disposed on certain selected squares of the grid and are retained by the first player whose playing pieces lands or comes to rest on the square, thus representing the player's "catch". When all of these fish have been removed from the board, at least one session or portion of the game is completed. Instructions are provided on additional selected squares of the grid, some of which may result in bonuses or rewards of larger catches of fish for the player stopping on the square, and some of which may result in a set-back or penalty for the player landing thereon. Groups or sets of chance cards are arranged on the printed boards and are drawn by players during movement of their playing pieces on the grid in accordance with certain of the squares on which the playing pieces come to rest, said chance cards providing random information or instructions for the players.

5 Claims, 8 Drawing Figures

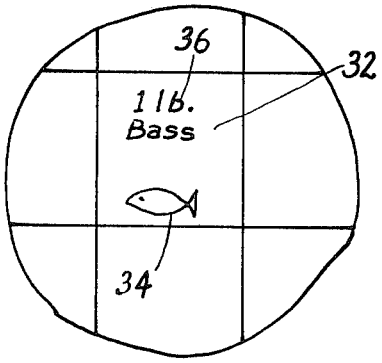
Fig. 2
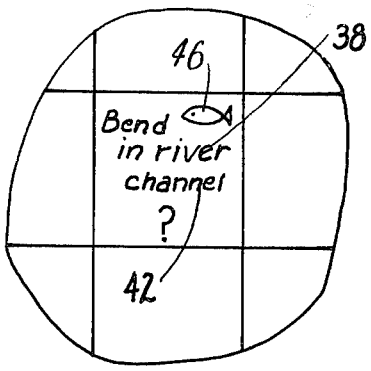
Fig. 3
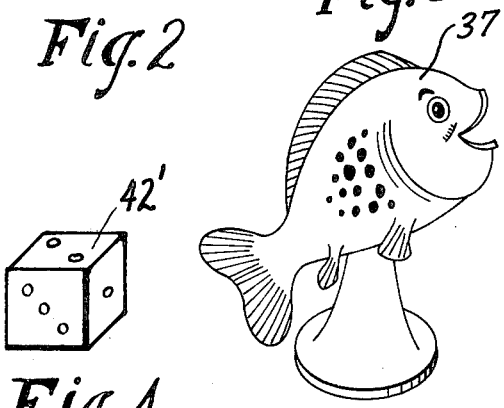
Fig. 8
Fig. 4
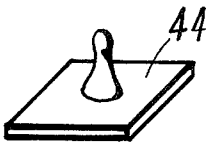
Fig. 5
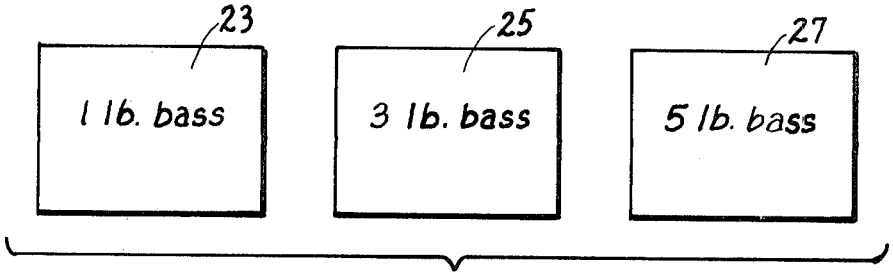
Fig. 6
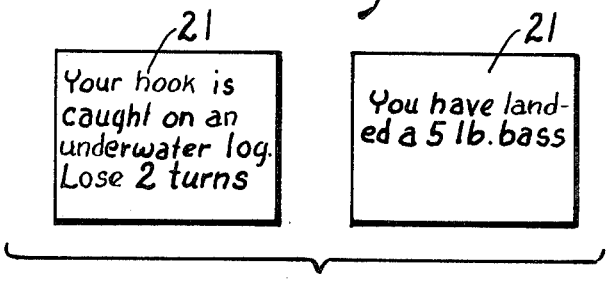
Fig. 7

BASS ANGLERS FISHING CLASSIC GAME

BACKGROUND OF THE INVENTION

1. Field of the Invention

This invention relates to improvements in games and more particularly, but not by way of limitation, to a game board type game having movable playing pieces for each player and the moves of the players being determined by casting of at least one die, and wherein the end result of the game closely simulates the fisherman's tournament known as the Bass Masters Classic.

2. Description of the Prior Art

There are many popular game board type games in widespread use today wherein playing pieces are manipulated with respect to the game board in accordance with the throw of dice. Many of these games are generally reminiscent of actual or real life enterprise, such as the well known game Monopoly, a trademark of Parker Bros., and include chance selection cards which provide both rewards and penalties for the players, thus enhancing the overall excitement and enjoyment of the game.

Fishing has become extremely popular in this country today, and a relatively recent tournament known as the Bass Masters Classic has been instigated which includes a 3 day activity, with the winner of the tournament being proclaimed at the end of the 3 days in accordance with the overall poundage of the fish being caught by the entries during the tournament. At the present time, however, there is no game of the game board type available for simulating the popular fishing event.

SUMMARY OF THE INVENTION

The present invention contemplates a fishing game comprising a game board having a representation of a lake and surrounding land area, and the like, printed thereon, and divided into playing squares. Each player moves his individual playing piece or "token" along a random path in accordance with the number showing when throwing a single die, although it will be apparent that two or more dice may be utilized, if desired. The player may move in any direction, as long as the spaces or squares are touching one another. He may move forward, backward, side to side, or diagonally, as he desires, moving one square for each number on the exposed face of the die. The game board is provided with a plurality of squares picturing a fish, and a token fish, preferably constructed of a suitable plastic material, or the like, is loosely disposed on each of these marked squares at the beginning of each game session. Preferably, each of the fish tokens represents a one pound fish, and when a player is able to manipulate his playing piece for landing or stopping on one of these squares, he picks up the fish and adds it to his catch. When all of these fish tokens are gone, the game, or at least that particular session of the game, is over. However, there are many other squares on the game board on which a player may land or stop his playing piece which may result in catching larger fish, which is considered an advantage since the end result of winning the game depends on the overall poundage of the player's catch. When he lands on these other squares, he picks up a card from the coordinated stack of "chance" cards which are designated for the square on which he has landed. These cards have various directions, including some that are disadvantageous or penalties, and some that are advantageous or rewards, and some that are neutral. Of course, the player ending the game with the largest number of pounds of catch is the winner. The entire game preferably includes three complete games or sessions, thus corresponding to the three day event of the Bass Masters Classic tournament.

BRIEF DESCRIPTION OF THE DRAWINGS

FIG. 2 is an enlarged portion of a game board as shown in FIG. 1 illustrating one type of playing square of a game embodying the invention.

FIG. 3 is a view similar to FIG. 2 showing another type of game square for playing of a game embodying the invention.

FIG. 4 is a perspective view of a die such as may be utilized in the playing of a game embodying the invention.

FIG. 5 is a perspective view of a typical playing piece as may be utilized in the playing of a game embodying the invention.

FIG. 6 is a plan view of a plurality of cards each representing individual fish sizes by weight, and as may be utilized in the playing of a game embodying the invention.

FIG. 7 is a view similar to FIG. 6 illustrating chance cards which may be utilized during the playing of a game embodying the invention.

FIG. 8 is a perspective view of a fish token such as may be utilized during the playing of a game embodying the invention.

DESCRIPTION OF THE PREFERRED EMBODIMENT

Figure 1:
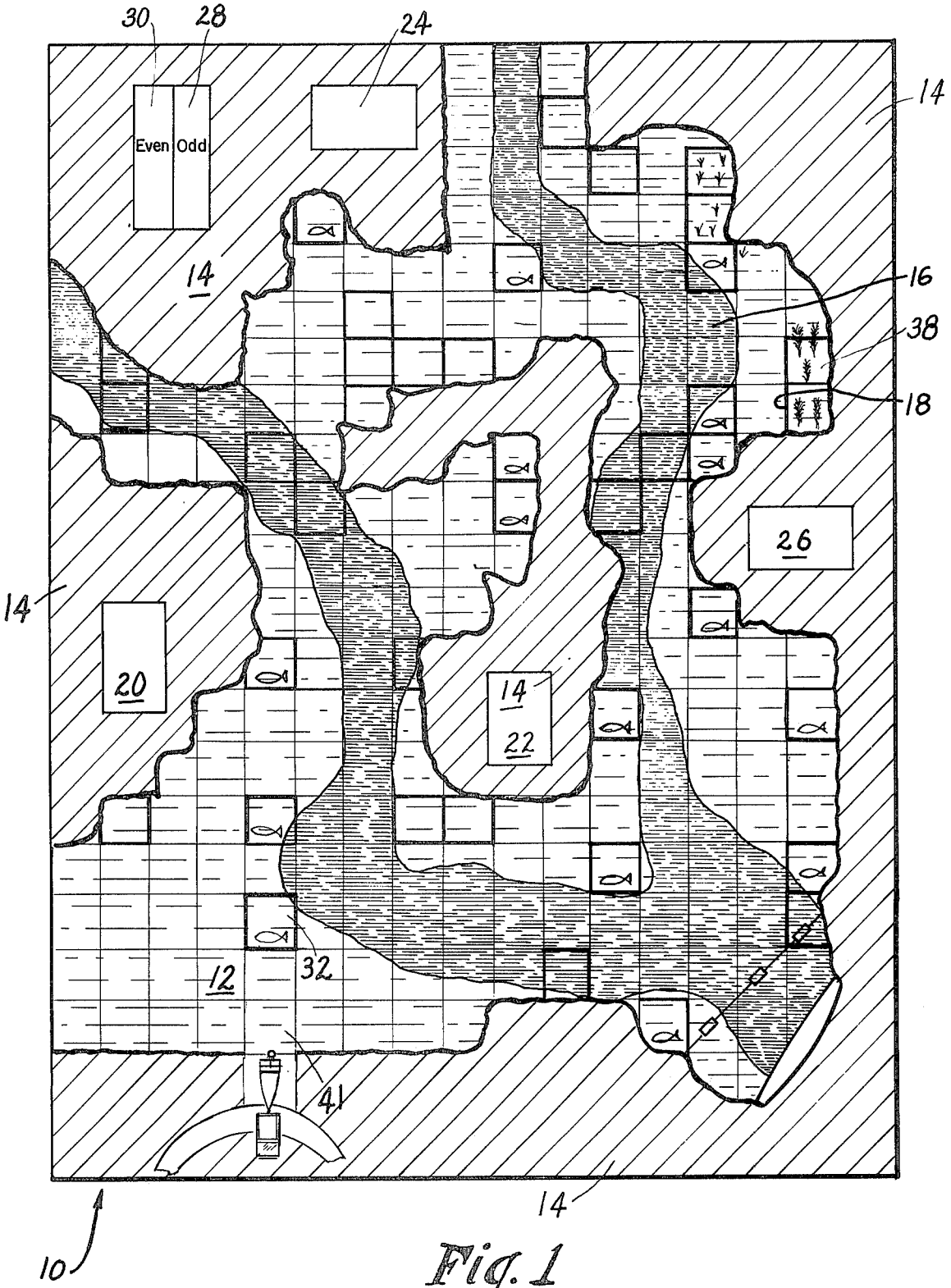
FIG. 1 is a plan view of a game board for a game embodying the invention.

Referring to the drawings in detail, reference character 10 generally indicates a game board which may be utilized for the playing of a fishing tournament game of the invention. The board 10 may be of any usual or well known type of construction, and is preferably substantially rectangular in overall configuration, with a centrally disposed hinge line (not shown) extending across the shorter dimension thereof, whereby the board 10 may be of a relatively large overall or completed size for facilitating the playing of the game, but may be conveniently folded along the hinge line into a smaller size for storage when not in use. One surface of the board 10 is preferably printed or otherwise provided with a substantially graphic or pictorial representation of a fishing area, as indicated by the portions 12 identified by broken horizontally extending lines, and land or earth areas 14 identified by angularly disposed shading lines. For purposes of simulating a geographic location, it may be preferable to include an area 16, depicted by closely spaced horizontal lines in FIG. 1, which represents a deep water channel area in the lake or water area 12. Of course, the actual representation of the lake 12 and land portions 14 on the game board 10 may be pictorially depicted to closely resemble the actual equivalent of these areas, with suitable coloring being utilized for lending a certain aspect of reality during the playing of the game.

Whereas the entire exposed surface of the game board 10 may be provided with a grid pattern imprinted thereon, it may be preferable to provide a grid pattern on the water or lake areas 12 only, whereby a plurality of rows of playing squares 18 will be provided throughout the entire water area or lake 12. For convenience, it may be preferable to imprint or otherwise indicate "special" areas on the surface of the board 10, such as the rectangles 20, 22, 24, 26, 28 and 30, spaced on the playing surface as shown in FIG. 1. The rectangle 20 may be provided for receiving a stack of chance cards 21 thereon which may be drawn by the players during play of the game for receiving random instructions, as will be hereinafter set forth. The rectangle 22 may be provided for receiving a stack or plurality of cards 23 which represent a fish, preferably a bass, size according to weight, as for example, a 1 pound bass. The rectangle 24 may be provided for receiving a stack or plurality of cards 25 which represent another size fish according to weight, as for example, a 3 pound bass. The rectangle 26 may be provided for receiving a stack or plurality of cards 27 which represent still another size fish according to weight, such as a 5 pound bass. The rectangles 28 and 30 are preferably included as reminders for rewards and/or penalties during the game resulting from a player's election of a special throw of the die in accordance with whether the player throws an even or odd number on the die, as will be hereinafter set forth. Of course, the rectangles 28 and 30 may be omitted, if desired. If the rectangles 28 and 30 are printed on the playing surface of the board 10, it is preferable to print the word "even" on one of the rectangles, such as the rectangle 30, and the word "odd" on the other rectangle, such as the rectangle 28. In addition, the words "3 lb. bass" may be printed on the rectangle 30, and a "0" may be printed on the rectangle 28, all for a purpose as will be hereinafter set forth.

Certain squares 18 of the grid are specifically marked for use during the playing of the game. These specific squares are preferably diposed on the grid in a random pattern whereby a certain amount of skill and/or preplanning must be utilized during the playing of the game for landing on the special squares. For example, some of the squares as indicated at 32 in FIG. 2 are provided with suitable indicia 34 imprinted or otherwise indicated thereon which is representative of a fish, and additional indicia 36 is preferably included thereon stating "1 lb. fish". A token 37 representing the one pound fish is loosely disposed on each square 32 at the beginning of each session of the game. Additional squares on the grid, such as the square 38 shown in FIG. 3 preferably include suitable indicia 46 printed thereon representing a fish, with additional indicia 42 thereon including a statement of water conditions or the like in the lake area, such as "Bend in the River Channel", or the like, which correesponds with water conditions occuring in nature to lend realism in the playing of the game and which indicate that the player whose token has "landed" thereon may select a chance card 21. The manner in which these specially marked squares enter into the playing of the game will be hereinafter set forth in detail. It is preferable to indicate on one of the squares, such as the square 41 shown in FIG. 1, the notation indicating the start-finish position.

At least one die 42' of the usual or well known type may be utilized in the playing of the game for determining the moves of each player. Whereas it is preferable to use a single die 42', it will be readily apparent that two or more dice may be utilized, if desired. In addition, each player is provided with a playing piece as generally indicated at 44 in FIG. 5. The playing pieces 44 may be of any suitable configuration. As shown herein, the pieces 44 may all be of a substantially identical configuration but each of a different color for distinguishing one player from another on the board 10. However, it will be apparent that the playing pieces 44 may be in the form of articles of normal use in actual fishing activity, such as various types of fishing boats, an oar, a boot, or the like. In any event, each player is provided with his own distinctive playing piece for use during the playing of the game.

In order to play the game of the invention, a token fish is loosely placed on each square 32 on the board 10, the chance cards 21 are shuffled and placed on the rectangle 20, the fish size indicating cards 23, 25 and 27 are placed on the respective rectangles 22, 24 and 26, and each player takes a turn, in repeated order of playing, until the game has ended. The sequence of playing may be determined in any well known manner, such as by drawing straws, casting lots, or by the sequential numbers of a cast of the die 42'. Once having established the order of playing sequence, each player, in turn, throws the die 42', and moves his playing piece 44 along the squares of the grid in accordance with the number showing on the top of the face of the die 42', with one square equalling one number on the die. For example, a player may move across five squares if the number exposed on the upper face of the die 42' is a five. Each player initially starts at the start-finish square 41, and may move his playing token or playing piece 44 at random along the squares of the grid as long as each successive square into which he moves is touching the square he has just vacated. The playing piece 44 may move along straight lines, either forward, backward, or sideways, or may move diagonally, as long as each of the two successive squares have either a side or corner in common. Thus, the players may move rather freely over the surface of the lake or water area 12. When a player has manuevered his playing piece in such a manner that he is the first player to land or stop on a square 32, he picks up the fish token and removes it from the board 10 for the rest of that particular game session, and subsequent players landing on the empty square 32 receive nothing. At the same time, he picks up a 1 pound bass card and retains it in his possession to represent a portion of his catch. At this time, however, he may make a decision. He may retain his 1 pound bass as a "sure thing" or he may gamble to either improve his catch or lose it altogether. If the player lands on a square 32 under the conditions just described, he may have an extra throw of the die 42'. If the number exposed on the top surface of the die is an even number, he may draw a 3 pound bass card in lieu of the 1 pound bass card, thus bettering his position. However, if the number exposed on the top surface of the die 42' is an odd number, he loses his catch entirely and must relinquish his one pound bass card, thus being penalized. When all of the fish tokens have thus been removed from the squares 32, at least this particular session of the game is over, it being preferable that the entire game include or consist of three sessions.

However, when a player maneuvers his playing piece 44 in such a manner that he lands or stops on a square 38, he picks up or draws the top chance card 21 from the stack, and proceeds in accordance with the instructions printed thereon. Many of these instructions are beneficial, or rewards. For example, the instructions may read "you have landed a 5 pound bass (or 1 pound base or 3 pound bass)", whereupon the player may pick up one of the cards representing the particular size fish indicated for adding to his catch. Other of the chance cards may be penalties, such as "You have caught your hook on a hidden log. Lose two turns", whereupon the player must forfeit his next two turns. Other penalty instructions might be "You have lost your last catch", whereupon the player must return his last catch to the appropriate stack of cards. Of course, some of the instructions on the chance cards may be neutral, but still lend to the overall anticipation of the unknown while playing the game.

When the exposed fish tokens have all been removed from the board 10, or from the squares 32 of the board 10, the session of the game is over. However, it will be apparent that many times it may be desirable to travel around the lake area 12 for a considerable length of time in a manner for avoiding the squares 32 in order to land on the more "chancy" squares 38 for the hope of increasing the catch before the end of the game, or game session. In other instances, it may be desirable to stop on the squares 32 as soon as possible in order to retrieve the fish tokens thereon and stop the game as quickly as possible in order to protect your own catch and reduce the time in which the other players have to accumulate fish poundage. Thus, each session of each complete game may be entirely varied with respect to the other sessions, thus reducing any monotony from continued playing of the game, and providing many hours of pleasant and entertaining pastimes.

From the foregoing it will be apparent that the present invention provides a novel game particularly designed and constructed for simulating the well known Bass Masters Classic fishing tournament. The game includes a game board which is pictorially representative of a fishing area, and each player is provided with an individualistic playing piece which he may move at random along the lake or water area in accordance with a throw of a die. Certain chance areas are provided for lending an atmosphere of the unknown to the game, and increase the overall anticipation and excitement of the game. The game preferably includes three sessions in order to lend an atmosphere similar to the fishing tournament, and may be readily played and enjoyed by young and old alike. The length of each game session may be varied by skill combined with chance, rendering each game session completely different from each other game session.

Whereas the present invention has been described in particular relation to the drawings attached hereto, it should be understood that other and further modifications, apart from those shown or suggested herein, may be made within the spirit and scope of this invention.

What is claimed is:

1. A fishing tournament game comprising a game board having a fishing area representation on one face thereof to provide a playing surface, said fishing area representation comprising land areas and water areas, grid means provided at least on the water areas to define a plurality of playing squares, a first plurality of said playing squares being provided with instructions indicating a given size fish by weight and for loosely receiving a token of the same thereon, each of said fish tokens being of a size to fit with one of said first playing squares and being sufficient in number to fill all of the first playing squares at the start of the game, a second plurality of said playing squares being provided with indicia relating to a selection of chance conditions, a plurality of chance cards provided in combination with said playing board and cooperating with said second plurality of playing squares and having information thereon for providing random instructions for the playing of the game, a plurality of fish size indication cards provided in combination with the board and corresponding with the information on the chance cards, individual playing token means provided for each player of the game, and at least one die provided for determining the moves of each playing token across the grid.

2. A fishing tournament game as in claim 1 wherein card resting positions are designated on the playing surface for receiving the chance cards and fish size indication cards thereon.

3. A fishing tournament game as set forth in claim 1 and including odd and even indication means cooperating with the die to provide penalties or rewards during the playing of the game.

4. A fishing tournament game as set forth in claim 1 wherein said first and second plurality of playing squares are randomly spaced on the playing surface.

5. A fishing tournament game as set forth in claim 1 wherein the playing board is substantially rectangular, and the fishing area representation is colored to correspond with a realistic situation.

* * * * *